United States Patent [19]

Brooks et al.

[11] 4,229,880

[45] Oct. 28, 1980

[54] COMBINED EATING UTENSIL

[75] Inventors: Henry W. Brooks, Minot, N. Dak.; Gloria C. Nichol, 2005 S. Blautvelt, Sioux Falls, S. Dak. 57105

[73] Assignee: Gloria C. Nichol, Sioux Falls, S. Dak.

[21] Appl. No.: 14,721

[22] Filed: Feb. 23, 1979

[51] Int. Cl.[3] ..... B26B 11/00

[52] U.S. Cl. ..... 30/142; 294/1 R; 30/169

[58] Field of Search ..... 30/136, 142, 169; 294/1 R; 15/236 R

[56] References Cited

U.S. PATENT DOCUMENTS

| | | | |
|---|---|---|---|
| 421,995 | 2/1890 | Reibnitz | 15/236 R |
| 1,325,540 | 12/1919 | Spahr | 30/169 |
| 1,354,709 | 10/1920 | Williams | 30/169 |
| 1,579,495 | 4/1926 | Stroud | 30/169 |
| 1,704,329 | 3/1929 | Klaus | 30/169 X |
| 2,417,585 | 3/1947 | Cahill | 15/236 R |
| 4,159,839 | 7/1979 | Sigler | 294/1 R |

*Primary Examiner*—Jimmy C. Peters

*Attorney, Agent, or Firm*—Fleit & Jacobson

[57] ABSTRACT

A combined eating utensil usable as a holder, pusher, blocking member, and knife. The utensil is a generally planar member having a longitudinally-extending straight bottom edge terminating in upwardly extending arcuate-shaped side portions. Upper ends of the side portions are connected to each other to define the top of the utensil. At least one of the side portions has a part thereof sharpened to define a cutting edge. A profiled portion is positioned above the bottom edge to facilitate gripping of the utensil by a user.

4 Claims, 3 Drawing Figures

COMBINED EATING UTENSIL

BACKGROUND OF THE INVENTION

1. Field of the Invention

This invention relates to combined eating utensils. More specifically, the present invention relates to an eating utensil having a first surface that can be either moved along the top of a plate to accumulate food positioned on the plate or placed in a blocking position on the plate, and a second surface that can be used as a knife.

2. Description of the Prior Art

Numerous eating utensils are previously known. The most common of which are knives, forks, and spoons. Combinations of these utensils are also well known. For instance, U.S. Design Pat. No. 219,945 illustrates a combined knife and spoon, while U.S. Design Pat. No. 57,683 ilustrates a combined knife and fork. Another type of utensil, which is designed for cleaning plates, is described in U.S. Pat. No. 2,417,585. The described utensil is a plate scraper that is adapted to be connected to a fork.

Most of the previously known devices perform their primary functions quite well; however, a problem is often encountered while eating certain foods. Specifically, when a fork is inserted into food accumulated on a plate, a portion of the food is positioned on the fork for removal from the plate. Another portion of the food, however is moved with respect to the bulk of the food on the plate. As a result, as the meal progresses, the food remaining on the plate tends to be spread over most of the plate. Further, some foods, due to their shape and size, are extremely difficult to pick up with conventionally used utensils. For instance, peas, due to their spherical shape, tend to roll with respect to the utensil, while rice grains, due to their small size, tend to be extremely difficult to pick up.

SUMMARY OF THE INVENTION

Accordingly, it is an object of the present invention to overcome the difficulties encountered with use of previously known eating utensils.

In accordance with the present invention, an improved eating utensil is provided that can be used as a pusher to accumulate food on a plate, as a holder or block that can be used in conjunction with other utensils to remove food from the plate, and as a knife.

The combined eating utensil of the present invention is a generally planar member having a longitudinally-extending straight bottom edge terminating in upwardly extending arcuate-shaped side portions. Upper ends of the arcuate-shaped side portions are connected to each other to define the top of the utensil. At least one of the arcuate-shaped side portions has a portion thereof shaped as a cutting edge. A profiled portion is positioned above the bottom edge to faciliate gripping of the utensil by a user.

The invention, and its objects and advantages, will become more apparent in the detailed description of the preferred embodiments presented below.

BRIEF DESCRIPTION OF THE DRAWINGS

In the detailed description of the preferred embodiments of the invention present below, reference is made to the accompanying drawings, in which.

DESCRIPTION OF THE PREFERRED EMBODIMENTS

Figure 1:
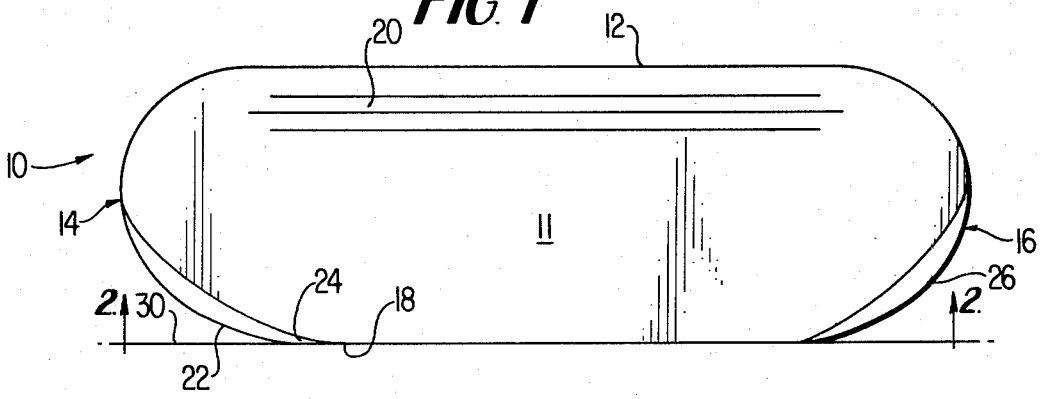
FIG. 1 is a front plan view of one embodiment of the present invention in an operative position.

Because eating utensils are well known, the present description will be directed in particular to elements forming part of, or cooperating more directly with, the present invention.

Referrng now to the drawings, one embodiment of the present invention is illustrated and will be described in connection with a combined eating utensil, which is generally designated 10. The utensil 10 is formed as a generally eliptical-shaped planar member having an upper edge 12, arcuate-shaped side edges 14 and 16, and a longitudinally-extending flat bottom edge 18. A profiled portion 20 is defined on upper parts of the planar member 11 to facilitate gripping of the utensil by a user. For instance, the profile portion 20 can be formed as a series of ridges and indentations.

Side edge 14 of the utensil 10 has a portion 22 thereof shaped to define a cutting edge or knife. The sharpened edge 22 is contiguous with a sharpened portion 24 of the bottom edge 18. If desired, the sharpened portion of the planar member 11 can be restricted to only one or both of the side edges 14 and 16. Thus, the portion of bottom edge 18 immediately adjacent to the sharpened portion 26 of side edge 16 is not sharpened.

Figure 2:
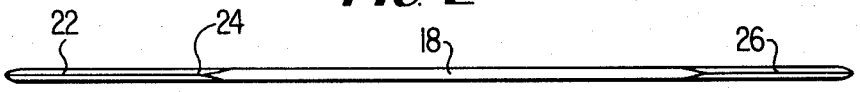
FIG. 2 is a view along line 2—2 of FIG. 1.
Figure 3:
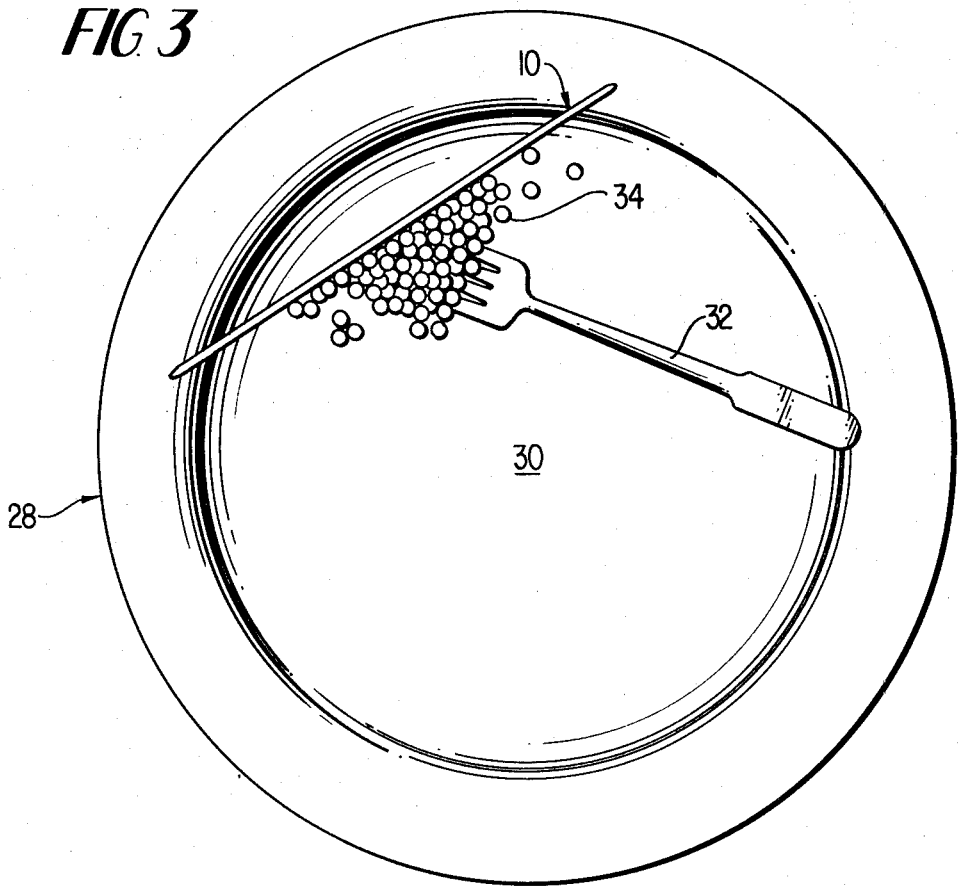
FIG. 3 is a top view of the embodiment of FIG. 1, during use.

As illustrated in FIG. 2, the bottom edge 18 generally has the shape of an elongated rectangle. As illustrated in FIGS. 1 and 3, this shape allows close contact between the bottom edge 18 and the upper surface 30 of a plate 28.

The combined eating utensil 10 of the present invention can be used in numerous ways. For instance, the sharpened portions 22, 24, and 26 can be used as knives to cut food or other items. In another use, the eating utensil 10 is positioned with bottom edge 18 in intimate contact with a surface, such as upper surface 30 of plate 28. The utensil 10 is then moved with respect to the surface to accumulate material, such as food, positioned on the surface. In still another use, the position of the utensil 10 is releasably fixed with respect to the surface and another utensil, such as a fork 32, pushes material, such as food 34, against the utensil 10 to facilitate positioning of the food on the utensil.

It will be appreciated that in order for the utensil 10 to properly perform its pushing, blocking, and holding functions, it must have certain minimum dimensions. Thus, one embodiment of the present invention utilizes a planar member 11 having a length l of 5 and $\frac{1}{2}$ inches and a height h of 1 and $\frac{1}{2}$ inches. Also, this embodiment utilizes cutting edges that extend for approximately $1\frac{1}{2}$ inches on each end. Preferably, the utensil 10 is formed of stainless steel so that the cutting edges can be sharpened; however, the utensil can be formed of plastics and other suitable materials. It will be appreciated that these dimensions are merely illustrative of one embodiment of the present invention.

The invention has been described in detail with particular reference to preferred embodiments thereof, but it will be understood that variations and modifications can be effected with the spirit and scope of the invention.

What is claimed is:

1. A one piece, combined eating utensil comprising a generally planar member having a longitudinally-extending straight bottom edge with the general shape of an elongated rectangle adapted to be positioned on a surface so that the bottom edge is in close contact with the surface whereby materials on the surface can be pushed by and pushed against the utensil, the bottom edge terminating in upwardly extending arcuate-shaped side portions, upper ends of the arcuate-shaped side portions being connected to each other to define the top of the utensil, at least one of the arcuate-shaped side portions having a part thereof sharpened to define a cutting edge, the top of the utensil including a profiled portion positioned above the bottom edge and adapted to be held by a user of the utensil.

2. A combined eating utensil according to claim 1, wherein the sharpened part of at least one arcuate-shaped side portion is interconnected with a sharpened edge portion of the bottom edge.

3. A combined eating utensil according to claim 1 or 2, wherein the utensil has a generally eliptical planar shape and is comprised of metal.

4. A combined eating utensil according to claim 3, wherein the metal is stainless steel.

* * * * *